United States Patent [19]

Madsen

[11] Patent Number: 4,815,886

[45] Date of Patent: Mar. 28, 1989

[54] EXPANSION JOINT FOR CONCRETE AND METHOD FOR USE

[76] Inventor: Evan L. Madsen, 38 West 700 South, Lehi, Utah 84043

[21] Appl. No.: 123,341

[22] Filed: Nov. 20, 1987

[51] Int. Cl.[4] ..... F16C 9/00

[52] U.S. Cl. ..... 403/28; 52/396; 404/64

[58] Field of Search ..... 52/396, 403; 403/265, 403/267, 28; 404/64, 65, 67, 53

[56] References Cited

U.S. PATENT DOCUMENTS

| | | | |
|---|---|---|---|
| RE165,542 | 2/1927 | Fischer | 404/65 |
| 2,370,153 | 2/1945 | Fischer | 404/64 |
| 2,405,844 | 8/1946 | Mortenson | 52/396 X |
| 3,119,204 | 1/1964 | Williams | 404/64 |
| 3,137,973 | 6/1964 | Williams | 404/64 X |
| 3,352,217 | 11/1967 | Peters et al. | 404/65 |
| 4,362,427 | 12/1982 | Mass et al. | 404/64 |

FOREIGN PATENT DOCUMENTS

| | | | |
|---|---|---|---|
| 580214 | 7/1959 | Canada | 404/65 |
| 790888 | 7/1968 | Canada | 404/65 |

*Primary Examiner*—James T. McCall

[57] ABSTRACT

A new self supporting expansion joint for use in the preparation of concrete products which comprises a single unit molded inverted T having a flat base adapted for resting on the ground and a vertical beam perpendicularly joined to the center of said base, said beam being thicker at the point of junction with the base than at the top of said beam, the plastic being used for at least a portion of said beam being prepared from a plastic material that compresses and expands on temperature change.

4 Claims, 3 Drawing Sheets

EXPANSION JOINT FOR CONCRETE AND METHOD FOR USE

BACKGROUND OF THE INVENTION

1. Field of the Invention

This invention relates to a new expansion joint for use in preparing concrete products. More particularly, the invention relates to a new type of expansion joint for concrete products that is self supporting and greatly facilitates the preparation of the concrete product.

Specifically, the invention provides a new type of expansion joint for concrete products that is self-supporting, gives a clean straight line and facilitates the screeding process. The new expansion joint broadly comprises a single unit plastic molded inverted T having a flat base adapted to resting on the ground and a vertical beam perpendicularly joined to the center of said base, said beam being thicker at the point of junction with the base than at the top of said base, the plastic used in the molding of at least a portion of said beam being prepared from a plastic material that compresses and expands on temperature change.

As a special embodiment, the invention further provides an expansion joint as described above wherein the center core of the said beam is filled with or prepared from a material which is more expandable and compressible than the material used for preparing the other portion of the expansion joint.

The invention further provides a method for using the above-noted expansion joints to produce improved concrete products. 2. Prior Art As is well known, concrete products, such as roadways, sidewalks, etc., expand and contract on change of temperature, and this in many case causes the concrete to crack and break up. To avoid the problem, it is general policy in the construction business to introduce expansion joints at frequent locations in the product to absorb the expansion or contraction without breaking the concrete. Todate, these expansion joints have been prepared by utilizing board separators at frequent intervals during the pouring and then when the concrete begins to set up to remove the boards and introduce in their place a strip of soft expandable material.

The use of such expansion joints has not been entirely satisfactory. The addition of the board separators and their later removal is a time consuming and messy operation. In many cases, for example, the removal of the separator board is difficult and leaves an uneven and crooked dividing line in the finished product. Furthermore, the soft material inserted in the place of the board separator is easily worn and removed on subsequent use of the concrete product, and this leaves an unsightly and defective product. In addition, these problems are multiplied when one attempts to use such separators to form expansion joints in a curved or other artistically designed pattern.

It is an object of the invention, therefore, to provide a new type of expansion joint that solves the abovedescribed problems. It is a further object to provide an expansion joint that is self supporting and remains in the concrete product and does not have to be removed. It is a further object to provide a new type of expansion joint that insures a straight and clean line along the dividing line in the cured concrete product. It is a further object to provide an expansion joint that greatly facilities the screeding during the finishing of the concrete product. It is a further object to provide an expansion joint that can be easily used to form curved or other types of artistically desired patterns for the said expansion joint. In addition, it is a further object to provide new expansion joints that are economical to use and reduce the cost of the formation of concrete products, such as highways, runways, sidewalks, driveways, and the like. These and other objects will be apparent from the following detailed description thereof.

SUMMARY OF THE INVENTION

It has now been discovered that these and other objects can be accomplished by the new expansion joints of the present invention which present for the first time a practical and highly efficient joint for use in the production of improved concrete products.

The expansion joint of the present invention broadly a single unit plastic molded inverted T having a flat base adapted to resting on the ground and a vertical beam perpendicularly joined to the center of the said base, said beam being thicker at the point of junction with the base than at the top of said base, the plastic used in the molding of the new expansion joint at least at the top of said beam being of a heat expandable type. As a special embodiment, the new joint is as described above wherein the center core of the said beam is filled with or prepared from by co-extrusion a material which is more expandable and compressible than the material used for preparing the other portion of the expansion joint, such as foamed rubber.

The new expansion joints are preferably utilized by placing the rigid self supporting expansion joints of the invention on the ground or other surface in the proper place required for the formation of the concrete product, firmly attaching the expansion joint to the ground or other surface and to the side concrete forms so as to permit any movement of the forms and then pouring the concrete over and around the expansion joint and then screeding over the top of the said joint. The new expansion joint thus remains in the concrete product to give it added strength and stability.

The numerous advantages of the new expansion joints are quite evident. Firstly, the expansion joints remain in the concrete product and thus avoids the time consuming and messy procedure of first adding a separator and then remove the said separator and adding an expansion material. Thus, there is no need to be concerned about the correct time to remove the separator from the soft concrete and about adding the expansion material so as to still form a straight line. In addition, with the new expansion in their permanent place, the screeding over the top of the joint is very easy and insures the formation of a perfect layer of concrete close to the expansion joint, something that was not always possible with the removal of the old type separators. Certainly, the combination of the above-noted advantages brings about a higher degree of professionalism and a better profit margin to the concrete finishers and contractors.

DESCRIPTION OF THE DRAWING

The various object and features of the present invention will be more fully understood by reference to the accompanying drawing.

FIG. 6 is a cutway end view of

With reference to FIG. 1, 11 represents the new expansion joint, 12 the base of said joint with 13 being the vertical beam of said joint. 15 Is molded reinforcing strip along the both sides of the beam, and 14 is the enlarged portion of the beam at the point where the beam joins the base.

With reference to FIG. 2 which shows a modified expansion joint of the present invention, the joint is shown as 11, the base as 12, the beam as 13, the double reinforcing strips as 15 and 15A, orifices or openings for driving spikes or other means into the ground as 19, openings or knock-outs for passing reinforcing rods through the forms as 18 to permit tie-ins and give stability to the concrete.

FIG. 3 shows a typical expansion joint of the present invention possessing a vertical cavity 20 at the top of the beam13, with reinforcing strip 15, base 12 and openings for spikes at 21 and cap 31 for the cavity.

In FIG. 4, which is a top view of two joints connected together, the one joint is shown as 11A, the second as 11B, with the beams 13A and 13B respectively. The H connecting coupler is shown as 12 with legs 22A fitting around the beam of joint 11A and the legs 22B fitting around the beam of joint 11B.

With reference to FIG. 5 which is a cut away top view of forms prepared for the pouring of concrete highway section, the expansion joints of the present invention are shown as 11C and 11d. These joints are firmly attached to the side forms 23 by screws 24 which pass through the side forms into the end of the beams of the expansion joints. Reinforcing rods 26 pass through the openings 18 ending in sleeves 17 to add additional stability to the concrete product when poured. To permit quick and easy screeding the tops of the expansion joints 11C and 11D are flush and even with the tops of the side forms 23.

FIG. 6 is an end view of beam 30 showing the inner extruded plastic 28 and the outer extruded material 29.

DETAILED DESCRIPTION OF THE INVENTION

While the above-described description of the invention and the darwings have been made in rather specific terms, it should be understood that various changes can be made in construction and operation without departing from the scope of the invention.

The expansion joints of the present invention possessing the described base and perpendicular beam are preferably prepared by single unit molding in one piece by injection or extrusion molding. However, they can be prepared in less preferred manner by forming the beam and base separately and then securely joining the two together by suitable means, such as gluing, screwing, barreling, interlocking, and the like. However, such a procedure does not impoart the strength obtained by the single unit injection or extrusion.

Figure 6:
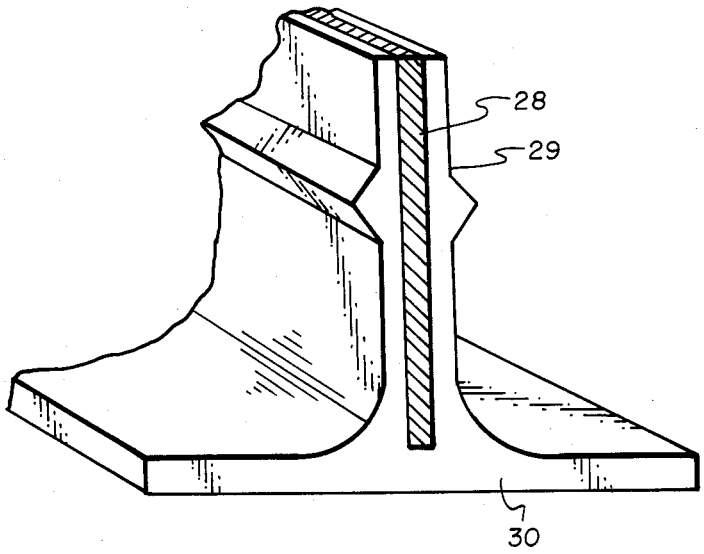

As a special embodiment, the invention provides the formation of the expansion joints by co-extrusion process wherein a tougher more rigid plastic is extruded to form the outside of the joint while the more flexible plastic which is more affected by the temperature in compression and expansion is extruded to form the center core as in FIG. 6.

The dimensions of the sections of the joints may vary depending on their intended use, e.g. for use in making highways, driveways, sidewalks, floors, and the like. In general, the base and the beam may be the same in thickness or may vary from each other. In general, the thickness of the base and the beam may vary from about ½ inch to about 2 inches in thickness. The beam, of course,must be thicker at the base than at the top and for this purpose the base of the beam may vary say from about 1 to 5 inches in width. In general, the bottom of the beam is at least 2 inches larger than the thickness of the top of the beam.

The width of the base and the height of the beam may also vary as desired. In most cases, a solid base is obtained when the base preferably varies in width from about 3 to 10 inches, and more preferably from 3 to 8 inches. The height of the beam may preferably vary from about 4 to 8 inches, and more from about 3½ inches to 6 inches.

As shown in the drawings, the beam preferably is reinforced by having 1 or more reinforcing strips projecting out from the side of the beam e.g. 14 to ¾ inches and about ¼ to ¾ inches in width parallel to the base. These strips are locking means which minimize the shifting, rising, sinking and separating of the concrete slab after it has been poured.

The new expansion joints may also possess one or more holes or orifices or push-outs in the base and/or beam in order to provide means for improving thestability of the said joint. For example, holes at 24 inch or 18 inch centers may be placed on each side of the base to permit spikes or other means to be pouned through the base into the ground to improve stability of the joint during pouring of the concrete. Holes or knockouts may also be provided preferably at 24 or 18 inch centers in the side of the beam so as to permit reinforcing rods with sleeves to be placed through the beam, again for stability or for improvement in the strength of the resulting concrete.

The plastic material to be used in the molding of the new joints may be any plastic substance that can be injection or extruded to form the desired joint. The plastic should of course be one that can be compressed when heated and will expand back when cold. Preferred examples of these include the thermoplastic polymers and copolymers, such as copolymers of butadiene and styrene, polymers of ethylene and propylene, polyvinyl chloride and copolymers of vinyl chloride with other monomers, such as vinyl acetate, vinyl butyrate, and the like.

As a preferred embodiment, the invention provides expansion joints wherein the center core of the joint beam has been co-extruded with a more flexible compressible material, such as foamed rubber, foamed polystyrene, and other suitable material that has been used heretofore for expansion joints.

Under the preferred embodiment then one has a joint prepared by co-extrusion wherein the outer shell of the joint is formed by extrusion of the more rigid and strong plastics, such as polyvinyl chloride, polypropylene and the like, and the center core extruded from material, such as the rubber polymers and copolymers of butadiene or the foamed rubbers and the like.

In a less preferred embodiment, the joint could be extruded to leave a center core cavity with a removable cap, and after the joint has been used and the concrete poured, the cap can be easily stripped off and the cavity could then be filled with the desired expandable material, such as the foamed rubbers or tar materials.

As noted, the new expansion joints are preferably formed so as to provide a very straight line during the the pouring of the concrete. It is possible, however, to prepare the expansion joints so as to provide curved lines, such as circles, S curves and the like so as to provide artistic lines in the poured product. Such modified products can be prepared by simple modification of the injection and extrusion processes.

Figure 1:
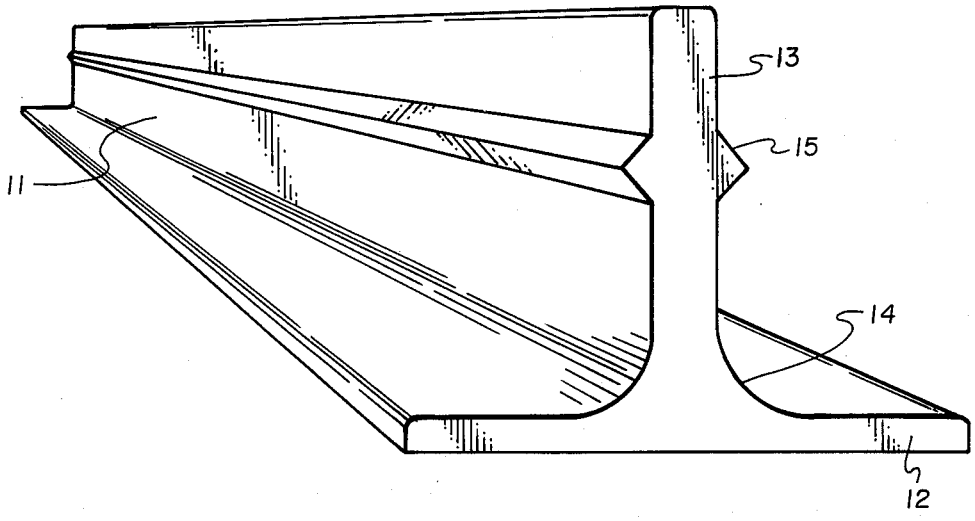
FIG. 1 is an end view of a typical expansion joint of the present invention.
Figure 2:
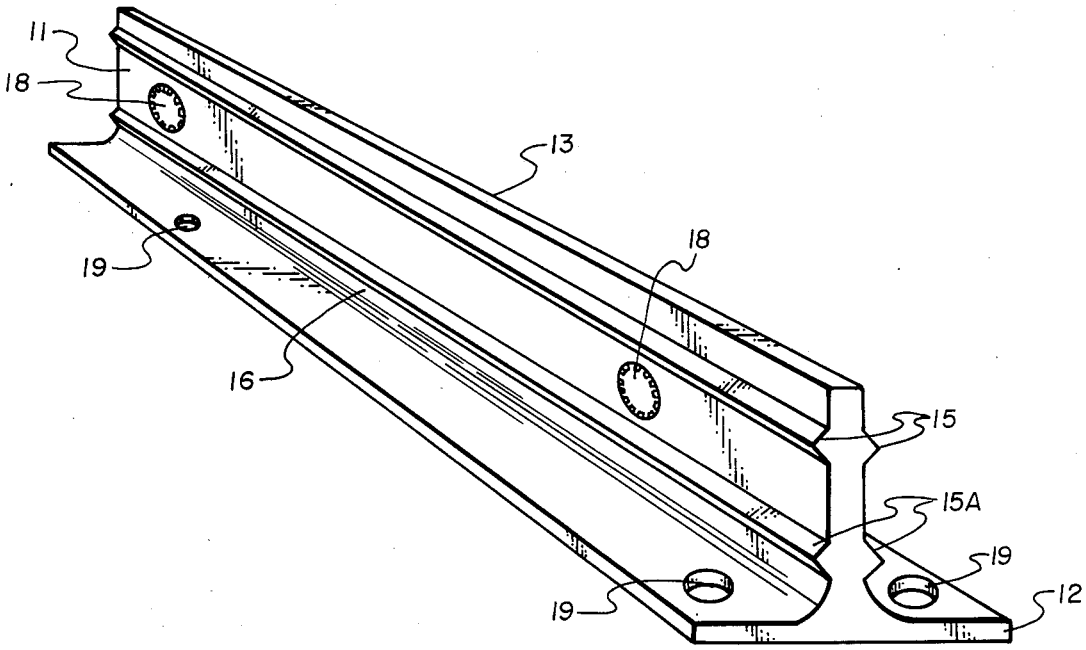
FIG. 2 is also an end view of an example of the new expansion joints showing a double reinforcing strip on the sides of the beam as well as other supports.
Figure 3:
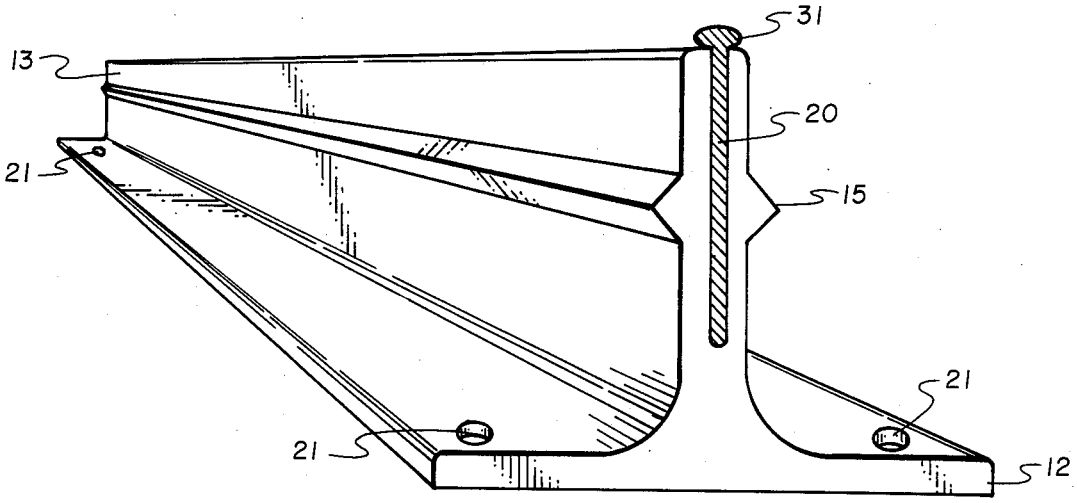
FIG. 3 is an end view of a typical expansion joint of the present invention showing the cavity at the top of the beam to be filled with expansion material.
Figure 4:
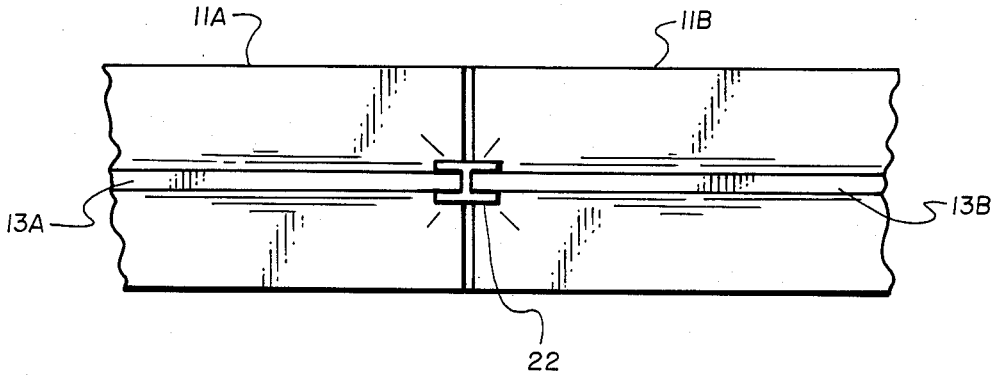
FIG. 4 is a cutaway portion of a top view of two joints being connected together with a H coupling agent.
Figure 5:
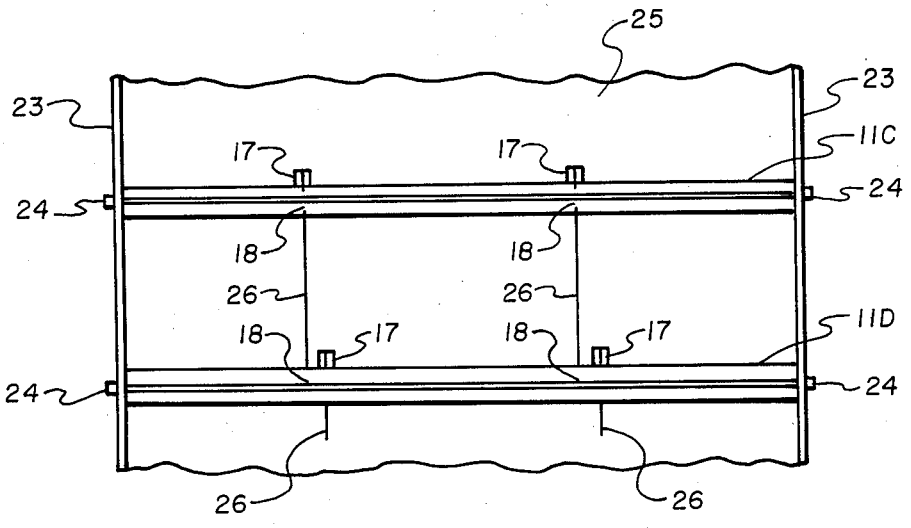
FIG. 5 is a cut away top view of a set of forms being created for the formation of a concrete highway section.

In many cases, it may be necessary to hook two or more of the expansion joints together, particularly in those cases involving the pouring of large areas, such as four lane highways, large floors for store houses, etc. In this case, it is possible to join two or more of the joints together by use of H coupling agents, such as shown in FIG. 4. These coupling agents are preferably prepared from metal and of such construction as to fit tightly around the edge of the beam, and if necessary nailed or screwed therein.

PREFERRED EMBODIMENT OF THE INVENTION

A preferred embodiment of the invention is described below. It should be understood, however, that this is given as a preferred assembly only and is not to be regarded as limiting the invention in any way.

A expansion joint is prepared by extrusion molding a joint from a copolymer of butadiene and styrene. The product had good strength as well as the ability to change on the application of heat as to the desired compression and expansion. The joint had the dimensions as follows: the thickness of the beam at the top was about ½ inch, the base in thickness was about ⅜ inch. The beam was about 3½ inches high and the base was about 4½ inches long. The beam was about ½ inch thick at the top but tapered off about 1½ inches down to have a base at the point of joining the base to be be about 2½ inches. Holes were provided at 24 inch centers along the 10 foot joint as well as in the side of the beam at 24 inch centers for utilization of the joint in forming concrete forms. The 10 foot lengths were capable of being joined together by use of metal H coupling agents.

A form was prepared for the pouring of concrete over an area of 20×20 ft. 2×4 Lumber was used to form the outside forms of the area and two of the expansion joints prepared as above were joined together by H coupling units and placed as expansion joints at the 10ft mark across the area and fasted to the outside lumber forms by screws. The expansion joints were fasted to the ground by pounding spikes through the holes in the base of the joints into the ground.

Concrete mix was then poured into the forms and was easily screeded off by passing a screed tool over the top of the lumber forms and the expansion joints. After cure, a very straight and clean line was formed along the top of the expansion joint.

A similar expansion joint was prepared with the exception that a cavity of about ¼ inches in width and 2½ inches in depth is created at the top of the expansion joint beam and a temporary plastic cap placed therein for use during the pour. After the concrete mix has been poured as above, the cap is removed and a thick rubber strip the size of the cavity is forced into the cavity to further act as an expansion material.

In a further experiment, a joint is prepared by co-extrusion wherein the inner core is prepared from foamed rubber to add additional expansion properties.

I claim as my invention:

1. A plastic self supporting rigid expansion joint for use in preparing concrete products which comprises a single unit molded inverted T having a flat base adapted for resting on the ground and a vertical beam perpendicularly joined to the center of said base, said being being thicker at the point of junction with the base than at the top of said base, and at least one rigid reinforcing strip running along both sides of the beam parallel to the base to provide locking means to keep the concrete from shifting, rising or sinking after pouring, the plastic used in the molding of at least a portion of said beam being a plastic material that compresses and expands on temperature change.

2. A plastic self supporting rigid expansion joint for use in preparing concrete products which comprises a single unit molded inverted T having a flat base adapted for resting on the ground and a vertical beam perpendicularly joined to the center of said base, said beam being thicker at the point of junction with the base than at the top of said base,and at least one rigid reinforcing strip running along both sides of the beam parallel to the base to provide locking means to keep the concrete from shifting, rising or sinking after pouring, the said joint being prepared by co-extrusion so as to have the outer shell of the said joint prepared from a strong, rigid plastic while the core in the center of the beam is prepared from a foamed plastic material, the plastic material used in the molding of at least a portion of said beam being a plastic material that compresses and expands on temperature change.

3. A plastic self supporting rigid expansion joint for use in preparing concrete products which comprises a single unit molded inverted T having a flat base adapted for resting on the ground and a vertical beam perpendicularly joined to the center of said base, said beam being thicker at the point of junction with the base than at the top of said base, and at least one rigid reinforcing strip running along both sides of the beam parallel to the base to provide locking means to keep the concrete from shifting, rising or sinking after pouring, the top of the beam possessing near the center thereof a vertical cavity which is capable of being filled with a material which expands and contracts on change of temperature, the plastic material used in the molding of at least a portion of said beam being a plastic material that compresses and expands on temperature change.

4. A process for preparing a layer of concrete on the ground surface which comprises laying parallel forms separated by the desired distance, placing plastic self-supporting rigid expansion joints as defined in claim 1 perpendicular to the parallel forms and separated by the desired distance, pouring concrete mix between the said forms, leveling the concrete and allowing it to cure, the said parallel forms being removed after cure but the plastic self-supporting rigid expansion joints being allowed to remain in the cured concrete.

* * * * *